US006659010B2

(12) United States Patent
Goernig et al.

(10) Patent No.: US 6,659,010 B2
(45) Date of Patent: Dec. 9, 2003

(54) PYROTECHNIC IGNITER ARRANGEMENT WITH INTEGRATED MECHANICALLY DECOUPLED ELECTRONIC ASSEMBLY

(75) Inventors: Thomas Goernig, Markt-Indersdorf (DE); Holger Wulff, Ingolstadt (DE)

(73) Assignee: Conti Temic microelectronic GmbH, Nuremberg (DE)

( * ) Notice: Subject to any disclaimer, the term of this patent is extended or adjusted under 35 U.S.C. 154(b) by 0 days.

(21) Appl. No.: 10/145,397

(22) Filed: May 13, 2002

(65) Prior Publication Data

US 2002/0166471 A1 Nov. 14, 2002

(30) Foreign Application Priority Data

May 12, 2001 (DE) ..... 101 23 282

(51) Int. Cl.[7] ..... F42B 3/10; F42B 31/12; F42C 11/00; F42C 9/12

(52) U.S. Cl. ..... 102/202.12; 102/202.5; 102/202.9; 102/202.14

(58) Field of Search ..... 102/202.5, 202.9, 102/202.12, 202.14

(56) References Cited

U.S. PATENT DOCUMENTS

| | | | | | |
|---|---|---|---|---|---|
| 3,229,632 | A | * | 1/1966 | Boswell et al. | 102/202.14 |
| 4,869,170 | A | * | 9/1989 | Dahmberg et al. | 102/202.5 |
| 5,142,982 | A | | 9/1992 | Diepold et al. | 102/202.5 |
| 5,495,806 | A | | 3/1996 | Willey | 102/202.14 |
| 5,634,660 | A | | 6/1997 | Fink et al. | 280/741 |
| 5,889,228 | A | | 3/1999 | Ewick et al. | 102/275.1 |
| 5,929,368 | A | | 7/1999 | Ewick et al. | 102/215 |
| 5,942,717 | A | | 8/1999 | Pathe et al. | 102/202.2 |
| 6,079,332 | A | * | 6/2000 | Marshall et al. | 102/202.5 |
| 6,082,265 | A | | 7/2000 | Sakamoto et al. | 102/206 |
| 6,085,659 | A | | 7/2000 | Beukes et al. | 102/206 |
| 6,166,452 | A | | 12/2000 | Adams et al. | 307/10.1 |
| 6,227,115 | B1 | | 5/2001 | Gruber et al. | 102/202.9 |
| 6,302,023 | B1 | * | 10/2001 | Wier | 102/202.2 |
| 6,324,979 | B1 | | 12/2001 | Troianello | 102/202.7 |
| 6,418,853 | B1 | | 7/2002 | Duguet et al. | 102/206 |
| 6,513,436 | B2 | * | 2/2003 | Bernard et al. | 102/202.3 |
| 2002/0002924 | A1 | | 1/2002 | Duguet et al. | |

FOREIGN PATENT DOCUMENTS

| | | |
|---|---|---|
| DE | 4002088 | 8/1990 |
| DE | 4435319 | 4/1996 |
| DE | 19629104 | 7/1997 |
| DE | 19610799 | 9/1997 |
| DE | 19805539 | 8/1999 |
| DE | 1983278 | 3/2000 |
| DE | 19836280 | 5/2000 |
| DE | 19951720 | 12/2000 |
| DE | 19930904 | 1/2001 |
| DE | 19940201 | 1/2001 |
| DE | 19940200 | 4/2001 |
| EP | 0279796 | 8/1988 |
| EP | 0555651 | 8/1993 |
| WO | WO97/21067 | 6/1997 |
| WO | WO00/09964 | 2/2000 |
| WO | WO00/40917 | 7/2000 |

OTHER PUBLICATIONS

U.S. patent application Publication No. US 2002/0002924 A1, Publication Date: Jan. 10, 2002, Duguet et al.

* cited by examiner

*Primary Examiner*—Michael J. Carone
*Assistant Examiner*—H. A. Blackner
(74) *Attorney, Agent, or Firm*—W. F. Fasse; W. G. Fasse

(57) ABSTRACT

A pyrotechnic igniter arrangement, especially for occupant protection devices in motor vehicles, includes a single common carrier substrate, an electronic assembly arranged on the carrier substrate in an electronic zone, an electrically ignitable ignition bridge arranged on the carrier substrate in a pyrotechnic zone, and a pyrotechnic charge in the pyrotechnic zone. A mechanical decoupling or parting feature, such as a frangible link or an elastically bendable neck, is provided in the carrier substrate between the pyrotechnic zone and the electronic zone, so that forces arising during ignition of the pyrotechnic charge are not transmitted through the carrier substrate into the electronic zone. The decoupling feature breaks or elastically yields when a load exceeding a prescribed threshold is applied thereto. The electronic assembly is protected from damage due to excessive loads, and remains functional even after ignition of the pyrotechnic charge.

20 Claims, 1 Drawing Sheet

PYROTECHNIC IGNITER ARRANGEMENT WITH INTEGRATED MECHANICALLY DECOUPLED ELECTRONIC ASSEMBLY

CROSS-REFERENCE TO RELATED APPLICATIONS

This application is related to U.S. patent application Ser. No. 10/145,398 filed May 13, 2002, and U.S. patent application Ser. No. 10/145,399 filed May 13, 2002. The entire disclosures of these two other commonly filed U.S. applications are incorporated herein by reference.

PRIORITY CLAIM

This application is based on and claims the priority under 35 U.S.C. §119 of German Patent Application 101 23 282.9, filed on May 12, 2001, the entire disclosure of which is incorporated herein by reference.

FIELD OF THE INVENTION

The invention relates to a pyrotechnic igniter arrangement with an integrated electronic assembly, especially for triggering passenger or occupant protection devices in motor vehicles, for example. The igniter arrangement includes a pyrotechnic zone for a pyrotechnic charge or active mass and an electrically ignitable ignition bridge, as well as an electronics zone for an electronic assembly, such as especially, the ignition electronics.

BACKGROUND INFORMATION

An igniter arrangement of the above mentioned general type is disclosed in German Patent DE 198 36 280 C1, for example. In that reference, a protective wall separates the pyrotechnic area or zone from the electronic area or zone. Furthermore, separate contact elements are provided in this protective wall, whereby these separate contact elements must be contacted on both sides of the wall, in order to connect the electronic assembly in the electronic zone with the ignition bridge in the pyrotechnic zone. A one-piece carrier arrangement or substrate cannot be used for both the ignition/pyrotechnic zone as well as the electronic zone, because of their physical separation by the protective wall.

German Patent Laying-Open Document DE 198 36 278 A1 discloses an igniter arrangement with a carrier arrangement or substrate for the ignition bridge as well as for the electronic assembly. The entire carrier arrangement is arranged in the ignition capsule with the pyrotechnic charge or active mass. However, the carrier arrangement is covered with a damping layer of shock absorbing material over a portion thereof, preferably at least in the area of the electronic assembly.

Another simple carrier arrangement or substrate, for example a circuit board, to be used as a supporting carrier for the entire ignition arrangement including the ignition bridge and the electronic assembly, is disclosed in published European Patent Application EP 0,555,651 B1, for example. Using such simple carrier arrangements is more economical than providing separate carrier arrangements for the pyrotechnic zone and for the electronic zone respectively. However, such simple carrier arrangements do not provide a comparably effective protection for the electronic assembly against the effects of pressure, temperature, or forces that arise during the triggering or ignition of the igniter arrangement.

This can be disadvantageous, if the pressure, temperature, forces, or other mechanical influences arising from the pyrotechnic zone in turn are transmitted to the electronic assembly and lead to a disruption thereof. Namely, the igniter arrangement is typically connected via its electronic assembly to a databus, which in turn is further connected to a central unit and other igniter arrangements, for example in an ignition bus for occupant protection devices in a motor vehicle. It is desired that an igniter arrangement should remain at least partially functional after its ignition, for example to confirm the proper ignition or the like. In any event, the electronic assembly must remain intact or undisturbed to an extent sufficient to ensure that the further data exchange on the ignition bus will not be interrupted or interfered-with by the igniter arrangement that has been ignited.

SUMMARY OF THE INVENTION

In view of the above, it is an object of the invention to provide an igniter arrangement which may be easily and economically manufactured, and which ensures that the, electronic assembly remains largely functional, even after triggering or ignition of the igniter arrangement, at least so that a further data transmission on the connected bus system will not be hindered or interfered with. Particularly, it is an object of the invention to protect the electronic assembly in the electronic zone from the mechanical influences, and especially the mechanical forces, arising in the pyrotechnic zone of the igniter assembly during ignition thereof. The invention further aims to avoid or overcome the disadvantages of the prior art, and to achieve additional advantages, as apparent from the present specification.

The above objects have been achieved in a pyrotechnic igniter arrangement with an integrated electronic assembly, according to the invention, wherein the pyrotechnic igniter arrangement includes a pyrotechnic area or zone, an electronic area or zone, a supporting carrier arrangement or substrate that extends between and into both the pyrotechnic zone and the electronic zone, a pyrotechnic charge or active mass and an electrically ignitable ignition bridge arranged in the pyrotechnic zone, and an electronic assembly arranged in the electronic zone. The electronic assembly is arranged on and electrically connected with the carrier arrangement in the electronic zone, while the ignition bridge is arranged on and electrically connected with the carrier arrangement in the pyrotechnic zone. The carrier arrangement has a parting or decoupling feature at a parting or decoupling location, for mechanically decoupling a first portion of the carrier arrangement located in the pyrotechnic zone from a second portion of the carrier arrangement located in the electronic zone. The parting or decoupling feature may comprise a frangible link or intended breaking area, or an elastically flexible and bendable area, of which the strength or stiffness has been reduced in comparison to the remainder of the carrier arrangement, so that this parting or decoupling feature will break or elastically yield in the event that mechanical loads applied thereto exceed a prescribed maximum load threshold. Thus, forces or mechanical loads or thermal loads exceeding the prescribed maximum load threshold will not be transmitted or coupled from the first portion of the carrier arrangement in the pyrotechnic zone to the second portion of the carrier arrangement in the electronic zone.

The basic idea of the invention is to provide a decoupling location or feature for mechanically decoupling the portion of the carrier arrangement located in the pyrotechnic zone from the rest of the carrier arrangement. This is achieved, as mentioned above, by reducing the strength or stiffness of the carrier arrangement in this decoupling location, so that the decoupling location will break, yield or flex in the event of a mechanical load exceeding a prescribed maximum load threshold being applied thereto. The decoupling location can, for example, be embodied as a frangible link feature, i.e. an intended breaking location, or as an intended flexing or bending location, or as a meltable soldered connection.

With the inventive features, it is not necessary to avoid the structural separation of the electronic zone and the pyrotechnic zone, for example by a protective wall therebetween, yet the invention still provides a simple carrier arrangement in common for the electronic assembly in the electronic zone as well as for the ignition bridge in the pyrotechnic zone. In a particular embodiment, the ignition bridge extends through a protective wall provided between the electronic zone and the ignition zone. The carrier arrangement is simply provided with one or more decoupling locations, which mechanically decouple the portion of the carrier arrangement located in the electronic zone from the portion located in the pyrotechnic zone, after ignition of the pyrotechnic charge or active mass, i.e. after the actual ignition pulse has been applied to the ignition bridge, yet preferably during the burning of the pyrotechnic charge. Thereby, the mechanical decoupling feature at the decoupling location prevents the further transmission of mechanical loads exceeding the prescribed acceptable load threshold level from the pyrotechnic zone to the electronic zone.

According to a preferred further embodiment feature, the portion of the carrier arrangement in the pyrotechnic zone is preferably at least partially surrounded by a sheath or encasement of a pressure absorbing first material, and furthermore, the portion of the carrier arrangement in the electronic zone is preferably at least partially, but preferably completely, enclosed or encased with a second material that is harder than the softer pressure absorbing first material in the pyrotechnic zone. Preferably, the protective wall and the encasing of the carrier arrangement in the electronic zone are embodied in an integral one-piece manner of this harder second material.

In a further preferred embodiment, the parting or decoupling feature or features, and/or the encasing of the carrier arrangement in the pyrotechnic zone, are dimensioned and embodied so that they will be separated for decoupling the two portions of the carrier arrangement only when an applied thermal and/or mechanical load in the pyrotechnic zone or on the carrier arrangement exceeds a prescribed thermal and/or mechanical load threshold during the burning of the pyrotechnic charge.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
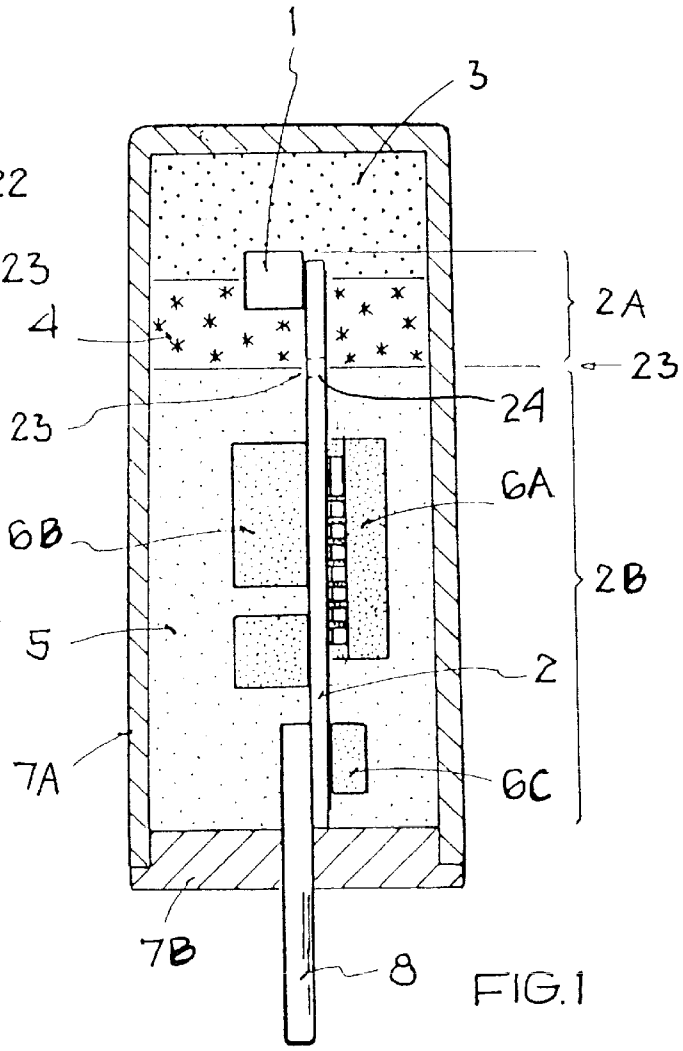
FIG. 1 shows a section through an igniter arrangement according to the invention, having a carrier substrate with a parting or decoupling feature between the pyrotechnic zone and the electronic zone.

FIG. 1 shows an especially preferred embodiment of an igniter arrangement which may, for example, be used as the igniter for a gas generator of a passenger or occupant protection device, e.g. an airbag, in a motor vehicle. The igniter arrangement comprises a two-part housing 7A, 7B including a housing cannister 7A and a housing lid 7B, a carrier arrangement or substrate 2, an ignition bridge 1 arranged on and electrically connected with the carrier arrangement 2, a pyrotechnic charge or active mass 3 arranged and adapted to be ignited by the ignition bridge 1, and an electronic assembly 6A, 6B, 6C, including various electronic components 6A, 6B, 6C, mounted on and electrically connected with the carrier arrangement 2 and adapted to electrically trigger or energize the ignition bridge 1.

The igniter arrangement is divided into a pyrotechnic area or zone A and an electronic area or zone B, whereby the pyrotechnic charge 3, the ignition bridge 1, as well as a first portion 2A of the carrier arrangement or substrate 2 are arranged in the pyrotechnic zone A, and a second portion 2B of the carrier arrangement 2 as well as the electronic components 6A, 6B, 6C mounted thereon are arranged in the electronic zone B. The ignition bridge 1 may be directly mounted on the carrier arrangement 2, but preferably is not directly mounted on the carrier arrangement 2, but rather on a separate carrier body which in turn is mounted on the carrier arrangement 2.

Figure 2:
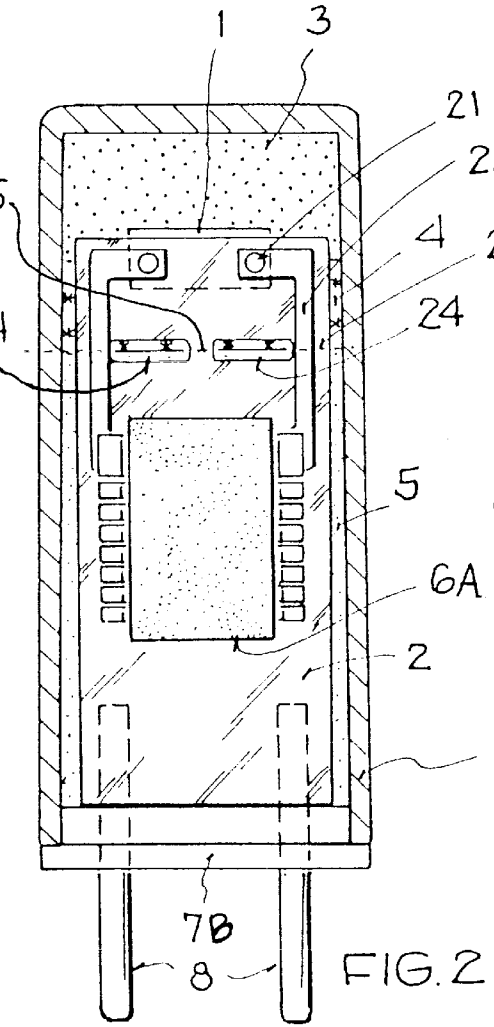
FIG. 2 is a sectioned-open view of the igniter arrangement of FIG. 1, as seen from the right side of FIG. 1 on a section plane perpendicular to that of FIG. 1.
Figure 3:
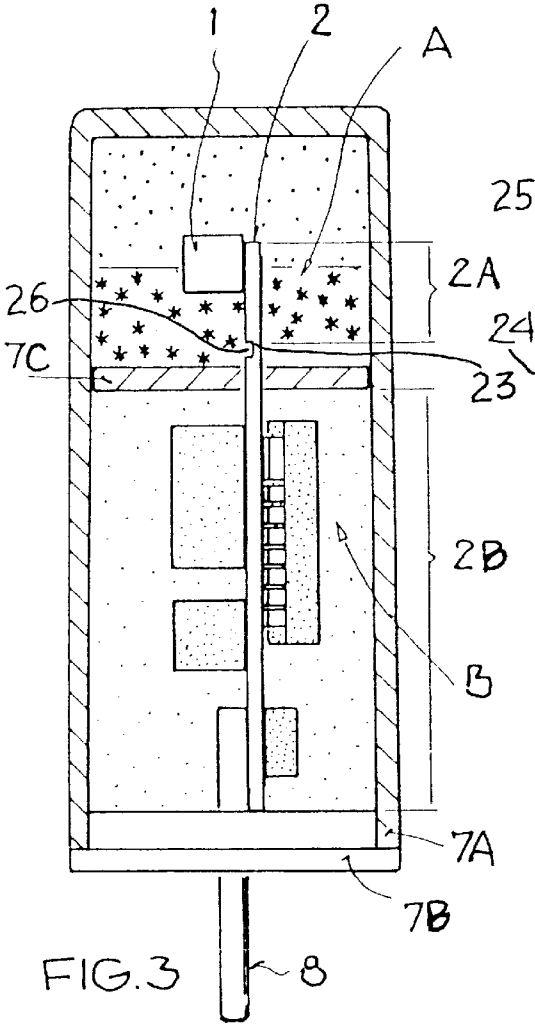
FIG. 3 is a sectional view similar to that of FIG. 1, showing the arrangement of a protective wall, and an alternative structure and position of the parting or decoupling feature of the carrier substrate.

The pyrotechnic zone A is preferably separated from the electronic zone B, for example by a separating protective wall 7C (see FIG. 3), or preferably directly by an encasing 5 of the electronic zone B with a suitable pressure resistant and temperature resistant material. Throughout this specification, terms such as "temperature resistant" and "pressure resistant" refer to a material that is able to withstand the temperatures and pressures that normally arise in the igniter arrangement upon the ignition of the pyrotechnic charge 3, while still providing its required functions and properties, and terms such as "pressure absorbing" refer to a material that is able to elastically absorb and damp forces or pressure applied thereto by the ignition of the pyrotechnic charge. FIGS. 1 and 2 show an embodiment in which the electronic zone B is encased or surrounded by an encasing 5 of the temperature and pressure resistant material, while FIG. 3 shows the embodiment using a separating partition or protective wall 7C.

The carrier arrangement or substrate 2 includes a parting or decoupling feature 23, 24 at a corresponding parting or decoupling location 23, for separating or decoupling the first portion 2A of the carrier arrangement 2 located in the pyrotechnic zone A, from the remaining second portion 2B of the carrier arrangement 2, after ignition of the pyrotechnic charge 3. Particularly, the one or more parting or decoupling features 23, 24 are so dimensioned, configured, and embodied, so that they will only be separated, i.e. to separate the two portions of the carrier arrangement 2, in the event that the applied load exceeds a prescribed thermal and/or mechanical load threshold during the burning of the pyrotechnic charge 3. The complete achieved separation of the carrier arrangement or substrate at the parting location 23 can be detected by means of the remaining interrupted conductor ends on the carrier arrangement 2, such as a circuit board. This physical separation or parting of the carrier arrangement 2 at the parting location 23 ensures that no forces, or at least no forces exceeding the load threshold, are transmitted through the carrier arrangement 2 from the pyrotechnic zone A to the electronic zone B and particularly to the electronic components making up the electronic assembly 6A, 6B, 6C.

The carrier arrangement or substrate 2 may, for example, be made of ceramic material with suitable metal layers deposited thereon to form conductor path structures 22 and contact zones 21, e.g. in the manner of any typically known circuit board, and the decoupling or parting feature 23, 24 can be embodied in this substrate as a frangible or intentionally breakable link between the two portions 2A and 2B of the carrier arrangement 2, as shown in the side view of FIG. 1, and the front elevation view of FIG. 2.

Particularly, in the illustrated embodiment of FIGS. 1 and 2, two cut-out oblong holes 24 are provided in the carrier substrate 2 along the parting line 23, so as to weaken the structure of the carrier substrate 2 at this location, so that the substrate will break along the parting line 23 if a load exceeding the designed load threshold is applied to the first portion 2A of the substrate relative to the second portion 2B thereof. The load threshold can be selected during fabrication, based on the dimensions, configuration, number, and placement of the holes 24, for example, and the corresponding characteristics of the frangible links or integral tabs 25 remaining to interconnect the two portions 2A and 2B of the substrate between the holes 24.

The electronic assembly 6A, 6B, 6C comprises electronic components or elements 6A for controlling the igniter arrangement via an energy and databus, with which the igniter arrangement is connected by means of contacts or pins 8, a protective circuit 6C that provides protection against interferences on the data bus, and an ignition energy reserve or store, especially an ignition capacitor 6B, as well as any suitable additional electronic circuit components or elements. The particular make-up of the electronic assembly is not critical for the invention, and it may be in accordance with any conventionally known electronic assembly for an igniter arrangement. It is simply important that the electronic assembly is arranged on the second portion 2B of the carrier arrangement 2 so that after decoupling or separation of the parting feature 23, 24 at the parting location 23, to separate the pyrotechnic first portion 2A of the carrier arrangement 2 with the ignition bridge 1 from the remainder of the carrier arrangement 2, the electronic assembly can still carry out its other functions, for example especially a self-diagnosis function as well as databus communication, and at least will not hinder or interfere with the external data exchange on the bus system.

As mentioned above, the embodiment of FIGS. 1 and 2 may involve an integral one-piece substrate 2 as the carrier arrangement, with merely a weakened area forming the parting or decoupling feature at the parting location 23. Alternatively, the carrier arrangement 2 may comprise two separate substrate portions or members 2A and 2B, that are connected to each other along the parting location 23, for example by a soldered connection that is established during the assembly or installation of the igniter arrangement. Due to the heat generated during the burning of the pyrotechnic charge 3, the soldered connection along the parting location 23 will melt or soften so as to achieve a separation or decoupling and thereby prevent the further transmission of loads from the first portion 2A to the second portion 2B of the carrier arrangement 2.

In this embodiment, the at least one solder connection is so dimensioned and embodied (e.g. with a suitable solder material) so that it is able to withstand the mechanical and thermal demands that arise in the motor vehicle field of application, and also is able to conduct the required ignition current to the ignition bridge 1, without melting or softening. However, the mechanical and thermal energy being released by the burning of the ignited pyrotechnic charge 3 is significantly greater than the ordinary mechanical and thermal operating loads, so that the at least one solder connection can be initially dimensioned and embodied with an adequate safety factor above the expected operating loads, while still ensuring a proper separation or decoupling once the pyrotechnic charge 3 is ignited. This is especially true because merely a softening, without complete melting, of the soldered connection is sufficient to bring about a decoupling that prevents the further transmission of forces from the pyrotechnic zone A to the electronic zone B through the parting location 23 of the carrier arrangement 2.

The carrier arrangement 2 is preferably further at least partially surrounded or enclosed by a pressure absorbing material 4 in the pyrotechnic zone A. This pressure absorbing material 4 is softer than the material of the separating protective wall 7C or the encasing 5 of the electronic zone B. For example, this pressure absorbing material 4 may be embodied in the manner of a so-called "soft glob top", which has a certain plastic or elastic deformability which serves to protect both the first portion 2A of the carrier arrangement 2 located in the pyrotechnic zone A as well as the protective wall 7C or the encasing 5 from the pressure forces or shock generated by the burning pyrotechnic charge 3. Therefore, the pressure resistance or strength of the protective wall 7C or the encasing 5 can be reduced when using such a pressure absorbing material 4, or the total security and reliability of the overall arrangement can be correspondingly increased.

As especially seen in FIG. 1, the pressure absorbing material 4 particularly preferably forms a buffer or cushion between the pyrotechnic charge 3 and the electronic zone B of the arrangement. The pressure absorbing material 4 is sufficiently elastic, so that when the load on the pyrotechnic first portion 2A of the carrier arrangement 2 exceeds the acceptable threshold load, the parting or decoupling feature at the parting location 23 will be separated, without hindrance from the pressure absorbing material 4.

The length of the first portion 2A of the carrier arrangement 2 in the pyrotechnic zone A is shorter than the length of the second portion 2B of the carrier arrangement 2 in the electronic zone B. This provides an improved lever effect such that the shorter first portion 2A can be reliably separated from the longer second portion 2B at the parting location 23 in the event of an excessive load being applied thereto.

The parting or decoupling feature or features 23 are preferably located on the carrier arrangement 2 in a transition area between the pyrotechnic zone A and the remaining portion of the carrier arrangement 2 enclosed by the protective wall 7C or the encasing 5.

As shown in FIG. 1, the parting location 23 at which the parting features are provided can correspond to an interface between the first pyrotechnic portion 2A and the second electronic portion 2B of the carrier arrangement 2. Alternatively, FIG. 3 shows a preferred position of the parting location 23 in an example embodiment with a separate protective wall 7C between the electronic zone B and the pyrotechnic zone A, whereby the carrier arrangement 2 extends continuously through both zones A and B as well as through the protective wall 7C, while the parting location 23 is positioned on the side of the protective wall 7C facing the pyrotechnic zone A.

FIG. 3 further schematically shows a second alternative embodiment of the decoupling feature in the form of a bending or flexing feature 26 at the decoupling location 23. Particularly, this bending or flexing feature 26 comprises an elastically flexible neck or narrowed portion 26 of the carrier arrangement or substrate 2, formed by a groove in the substrate. Such an elastically flexible neck is effective to provide an adequate protection against the transmission of mechanical loads from the pyrotechnic zone A to the electronic assembly 6A, 6B, 6C in the electronic zone B, because it allows free elastic flexing of the carrier substrate 2 at this location, so that no mechanical loads, or at least no excessive critical mechanical loads, are transmitted through this location from the pyrotechnic zone A to the electronic zone B. Thus, it is not necessary to achieve a complete parting or separation, but rather an elastic flexible yielding at the decoupling location 23 can be sufficient.

A pyrotechnic igniter arrangement as described herein is especially used for igniting passenger or occupant protection devices of an occupant protection system in a motor vehicle, whereby the occupant protection devices are connected with one another and with a central unit for carrying out a data exchange via a data bus. The electronic assembly especially includes an integrated communication circuit that carries out the data exchange via the data bus, whereby this communication circuit shall remain functional to carry out a data communication even after the igniter arrangement has been ignited.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A pyrotechnic igniter arrangement comprising:

a housing enclosing therein a pyrotechnic zone and an electronic zone;

a carrier arrangement arranged in said housing and extending with a first portion thereof into said pyrotechnic zone and with a second portion thereof into said electronic zone;

a pyrotechnic charge arranged in said pyrotechnic zone in said housing;

an electrically ignitable ignition bridge arranged on and electrically connected with said first portion of said carrier arrangement in said pyrotechnic zone; and an electronic assembly including at least one electronic component arranged on and electrically connected with said second portion of said carrier arrangement in said electronic zone;

wherein said carrier arrangement further includes, between said first portion and said second portion of said carrier arrangement, at least one mechanical decoupling feature adapted to at least partially mechanically decouple said second portion from said first portion.

2. The pyrotechnic igniter arrangement according to claim 1, wherein said carrier arrangement comprises a carrier substrate board.

3. The pyrotechnic igniter arrangement according to claim 2, wherein said carrier substrate board is an integral one-piece board integrally including said first portion, said at least one mechanical decoupling feature, and said second portion integrally interconnected with one another.

4. The pyrotechnic igniter arrangement according to claim 3, wherein said at least one mechanical decoupling feature comprises at least one hole or cut-out notch that weakens said carrier substrate board at a decoupling location of said at least one mechanical decoupling feature to facilitate parting of said second portion from said first portion of said carrier substrate board along said decoupling location.

5. The pyrotechnic igniter arrangement according to claim 4, wherein said at least one hole or cut-out notch is dimensioned and configured so that said carrier substrate board will break and said second portion will separate from said first portion along said decoupling location when forces generated by burning of said pyrotechnic charge are introduced into said first portion.

6. The pyrotechnic igniter arrangement according to claim 3, wherein said at least one mechanical decoupling feature comprises at least one narrowed neck that weakens said carrier substrate board at a decoupling location of said at least one mechanical decoupling feature to facilitate elastic flexing of said first portion and said second portion of said carrier substrate board relative to each other along said decoupling location.

7. The pyrotechnic igniter arrangement according to claim 6, wherein said at least one narrowed neck is dimensioned and configured so that said carrier substrate will elastically flex along said decoupling location when forces generated by burning of said pyrotechnic charge are introduced into said at least one narrowed neck.

8. The pyrotechnic igniter arrangement according to claim 2, wherein said carrier substrate board is not an integral one-piece board, said first portion is a first board member, said second portion is a second board member that is separate and non-integral with respect to said first board member, and said at least one mechanical decoupling feature comprises at least one soldered connection between said first board member and said second board member.

9. The pyrotechnic igniter arrangement according to claim 8, wherein said at least one soldered connection comprises a selected solder material and is dimensioned and configured so that said at least one soldered connection will weaken or separate when a thermal load or a mechanical load generated by burning of said pyrotechnic charge is introduced into said at least one soldered connection.

10. The pyrotechnic igniter arrangement according to claim 1, wherein said at least one mechanical decoupling feature comprises a third portion of said carrier arrangement having a reduced stiffness, so that said third portion is yielding when a mechanical load applied thereto exceeds a prescribed load threshold.

11. The pyrotechnic igniter arrangement according to claim 10, wherein said third portion comprises an elastically flexible narrowed neck of said carrier arrangement that is flexibly yielding when said mechanical load exceeding said threshold is applied thereto.

12. The pyrotechnic igniter arrangement according to claim 1, wherein said at least one mechanical decoupling feature comprises a frangible portion of said carrier arrangement having a reduced strength, so that said frangible portion will break when a load arising from ignition of said pyrotechnic charge is applied thereto.

13. The pyrotechnic igniter arrangement according to claim 1, further comprising a protective wall made of a pressure-resistant and heat-resistant first material arranged in said housing between said pyrotechnic zone and said electronic zone.

14. The pyrotechnic igniter arrangement according to claim 13, further comprising a pressure-absorbing second material at least partially surrounding said first portion of said carrier arrangement in said pyrotechnic zone, wherein said second material is softer than said first material.

15. The pyrotechnic igniter arrangement according to claim 13, wherein said at least one mechanical decoupling feature is arranged in a transition area between said pyrotechnic zone and said protective wall.

16. The pyrotechnic igniter arrangement according to claim 1, further comprising a pressure-resistant and heat-resistant first material at least partially surrounding said second portion of said carrier arrangement in said electronic zone, wherein an interface of first material further defines a separating boundary between said pyrotechnic zone and said electronic zone.

17. The pyrotechnic igniter arrangement according to claim 16, wherein said first material completely surrounds and encases said second portion of said carrier arrangement in said electronic zone.

18. The pyrotechnic igniter arrangement according to claim 16, further comprising a pressure-absorbing second material at least partially surrounding said first portion of said carrier arrangement in said pyrotechnic zone, wherein said second material is softer than said first material.

19. The pyrotechnic igniter arrangement according to claim 1, wherein said first portion of said carrier arrangement in said pyrotechnic zone has a shorter length than said second portion of said carrier arrangement in said electronic zone.

20. A pyrotechnic igniter arrangement comprising:

a housing enclosing therein a pyrotechnic zone and an electronic zone;

a carrier arrangement arranged in said housing and extending with a first portion thereof into said pyrotechnic zone and with a second portion thereof into said electronic zone;

a pyrotechnic charge arranged in said pyrotechnic zone in said housing;

an electrically ignitable ignition bridge arranged on and electrically connected with said first portion of said carrier arrangement in said pyrotechnic zone; and an electronic assembly including at least one electronic component arranged on and electrically connected with said second portion of said carrier arrangement in said electronic zone;

wherein said carrier arrangement further includes, between said first portion and said second portion of said carrier arrangement, mechanical decoupling means for connecting said first portion and said second portion with each other and withstanding and transmitting therethrough normal operating loads, and for breaking or elastically bending and preventing transmission therethrough of excessive loads that arise upon ignition of said pyrotechnic charge.

* * * * *

UNITED STATES PATENT AND TRADEMARK OFFICE

CERTIFICATE OF CORRECTION

PATENT NO. : 6,659,010 B2
DATED : December 9, 2003
INVENTOR(S) : Goernig et al.

It is certified that error appears in the above-identified patent and that said Letters Patent is hereby corrected as shown below:

Title page,
Item [56], References Cited, FOREIGN PATENT DOCUMENTS,
replace "1983278" by -- 19836278 --.

Signed and Sealed this

Twenty-seventh Day of April, 2004

JON W. DUDAS
*Acting Director of the United States Patent and Trademark Office*